US009129585B2

(12) United States Patent
Kanayama et al.

(10) Patent No.: US 9,129,585 B2
(45) Date of Patent: Sep. 8, 2015

(54) ELECTRONIC PERCUSSION INSTRUMENT

(71) Applicant: YAMAHA CORPORATION, Hamamatsu-shi, Shizuoka-ken (JP)

(72) Inventors: Emi Kanayama, Hamamatsu (JP); Masao Sato, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/204,411

(22) Filed: Mar. 11, 2014

(65) Prior Publication Data

US 2014/0260920 A1 Sep. 18, 2014

(30) Foreign Application Priority Data

Mar. 12, 2013 (JP) ..... 2013-049035
Mar. 11, 2014 (JP) ..... 2014-047225

(51) Int. Cl.

| | |
|---|---|
| ***G10H 1/32*** | (2006.01) |
| ***G10H 3/00*** | (2006.01) |
| ***G10H 3/14*** | (2006.01) |
| ***G10D 13/02*** | (2006.01) |

(52) U.S. Cl.
CPC ..... *G10H 3/146* (2013.01); *G10D 13/024* (2013.01)

(58) Field of Classification Search
USPC ..... 84/414, 411 R, 743
See application file for complete search history.

(56) References Cited

U.S. PATENT DOCUMENTS

| | | | | |
|---|---|---|---|---|
| 3,250,169 | A * | 5/1966 | Stone, Jr. et al. | 84/411 R |
| 4,606,525 | A | 8/1986 | Lombardi | |
| 4,669,349 | A | 6/1987 | Hyakutake | |
| 4,800,795 | A | 1/1989 | Yamashita | |
| 4,947,725 | A | 8/1990 | Nomura | |
| 5,182,416 | A | 1/1993 | Schweizer | |
| 5,337,646 | A | 8/1994 | Austin | |
| 5,583,307 | A | 12/1996 | Tobia, Jr. | |
| 5,585,581 | A * | 12/1996 | Rogers | 84/414 |
| 5,864,077 | A * | 1/1999 | Gatzen | 84/414 |
| 5,949,008 | A | 9/1999 | Augsburger | |
| 6,215,053 | B1 * | 4/2001 | Adinolfi | 84/411 R |
| 6,525,249 | B1 | 2/2003 | Suenaga | |

(Continued)

FOREIGN PATENT DOCUMENTS

| | | |
|---|---|---|
| EP | 1837860 A2 | 9/2007 |
| JP | 2009-128426 A | 6/2009 |

OTHER PUBLICATIONS

Related U.S. Appl. No. 14/204,247, filed Mar. 11, 2014.

(Continued)

*Primary Examiner* — Jeffrey Donels
(74) *Attorney, Agent, or Firm* — Rossi, Kimms & McDowell LLP

(57) ABSTRACT

An electronic percussion instrument includes a head, a frame, and an impact sensor. The back of the head is divided into a main area (e.g. a main strike area) and an auxiliary area. At least one connecting part is arranged above or below the main area in the back of the head and reduced in thickness compared to the auxiliary area, thus reducing vibration from being transmitted through the head. The impact sensor is attached to the back of the main strike area of the head via a cushion member. When the main strike area of the head is being struck with a beater, a vibration is caused to occur in the head and detected by the impact sensor to produce an electric signal which is used to generate an electronic musical sound while suppressing mechanical noise due to an impact between the beater and the head.

12 Claims, 13 Drawing Sheets

(56) References Cited

U.S. PATENT DOCUMENTS

| | | | | |
|---|---|---|---|---|
| 6,580,023 | B2 | 6/2003 | Belli | |
| 6,653,540 | B2 | 11/2003 | Izen et al. | |
| 6,686,526 | B2 | 2/2004 | Ezbicki | |
| 6,815,602 | B2 | 11/2004 | De Franco | |
| 6,828,494 | B2 * | 12/2004 | Toda | 84/411 R |
| 6,921,857 | B2 * | 7/2005 | Yoshino et al. | 84/738 |
| 6,927,330 | B2 | 8/2005 | May | |
| 6,949,701 | B2 | 9/2005 | Okumura | |
| 7,135,630 | B2 | 11/2006 | Maruhashi et al. | |
| 7,214,867 | B1 * | 5/2007 | Gatzen et al. | 84/411 R |
| 7,256,342 | B2 | 8/2007 | Hagiwara et al. | |
| 7,439,432 | B2 * | 10/2008 | Hiraku | 84/414 |
| 7,488,887 | B2 | 2/2009 | Mori | |
| 7,642,439 | B2 | 1/2010 | Fujii | |
| 7,723,596 | B2 | 5/2010 | Kelly | |
| 7,928,304 | B2 | 4/2011 | Eason et al. | |
| 8,039,724 | B1 * | 10/2011 | Norman et al. | 84/743 |
| 8,263,850 | B2 | 9/2012 | Hashimoto et al. | |
| 8,283,543 | B2 | 10/2012 | McBain | |
| 8,294,013 | B2 | 10/2012 | Lento | |
| 8,431,813 | B2 | 4/2013 | Mori | |
| 8,536,435 | B2 | 9/2013 | Mori | |
| 8,563,843 | B1 * | 10/2013 | Shemesh | 84/743 |
| 9,006,555 | B2 | 4/2015 | Mori | |
| 2003/0029301 | A1 | 2/2003 | Belli | |
| 2003/0037660 | A1 | 2/2003 | Suenaga | |
| 2003/0070533 | A1 | 4/2003 | Ezbicki | |
| 2003/0136244 | A1 | 7/2003 | Okumura | |
| 2003/0188624 | A1 | 10/2003 | Toda | |
| 2003/0188629 | A1 | 10/2003 | Suenaga | |
| 2004/0025663 | A1 | 2/2004 | Harada et al. | |
| 2004/0118269 | A1 | 6/2004 | Yoshino | |
| 2004/0159223 | A1 | 8/2004 | Kiyono et al. | |
| 2004/0211310 | A1 | 10/2004 | Hagiwara et al. | |
| 2004/0261603 | A1 | 12/2004 | May | |
| 2005/0150366 | A1 | 7/2005 | Susami | |
| 2006/0230912 | A1 | 10/2006 | Pickens | |
| 2007/0051231 | A1 | 3/2007 | Fujii | |
| 2007/0137460 | A1 | 6/2007 | Mori | |
| 2007/0169610 | A1 | 7/2007 | Pickens | |
| 2007/0295189 | A1 | 12/2007 | Kelly | |
| 2008/0229902 | A1 | 9/2008 | Mori et al. | |
| 2009/0000464 | A1 | 1/2009 | Mishima | |
| 2009/0019985 | A1 | 1/2009 | Casanta | |
| 2009/0229450 | A1 | 9/2009 | Hashimoto | |
| 2009/0241755 | A1 | 10/2009 | Yoshino et al. | |
| 2010/0175535 | A1 | 7/2010 | Lento | |
| 2010/0282047 | A1 | 11/2010 | Hashimoto et al. | |
| 2010/0307323 | A1 | 12/2010 | Mori | |
| 2011/0030529 | A1 * | 2/2011 | Chen | 84/414 |
| 2011/0138988 | A1 | 6/2011 | Lento | |
| 2011/0219938 | A1 | 9/2011 | McBain | |
| 2012/0174732 | A1 | 7/2012 | Martinazzi | |
| 2012/0266737 | A1 | 10/2012 | Mori | |
| 2013/0098227 | A1 | 4/2013 | Wei | |
| 2013/0112068 | A1 | 5/2013 | Rogers | |
| 2013/0152768 | A1 | 6/2013 | Rapp | |
| 2013/0340596 | A1 | 12/2013 | Yao | |
| 2014/0020548 | A1 | 1/2014 | Shemesh | |
| 2014/0026733 | A1 | 1/2014 | Hashimoto | |
| 2014/0060284 | A1 | 3/2014 | Yoshino | |
| 2014/0069256 | A1 | 3/2014 | Hashimoto | |
| 2014/0069265 | A1 | 3/2014 | Shih et al. | |
| 2014/0116229 | A1 | 5/2014 | Mori | |
| 2014/0208926 | A1 | 7/2014 | Shepherd | |
| 2014/0216234 | A1 | 8/2014 | Wei | |
| 2015/0027301 | A1 | 1/2015 | Shih et al. | |

OTHER PUBLICATIONS

Related U.S. Appl. No. 14/204,359; filed Mar. 11, 2014.
Related U.S. Appl. No. 14/204,180, filed Mar. 11, 2014.
Related U.S. Appl. No. 14/204,563, filed Mar. 11, 2014.
U.S. Office Action for related U.S. Appl. No. 14/204,359, mail date Jul. 9, 2014.
Office Action issued in U.S. Appl. No. 14/204,180, mailed Jan. 15, 2015.
Notice of Allowance issued in U.S. Appl. No. 14/204,359, mailed Feb. 4, 2015.
Non-Final Office Action issued in related U.S. Appl. No. 14/204,563, dated Apr. 14, 2015.
Office Action issued in related U.S. Appl. No. 14/204,247 dated Jul. 2, 2015.

* cited by examiner

FREQUENCY CHARACTERISTICS OF IMPULSIVE SOUNDS

ELECTRONIC PERCUSSION INSTRUMENT

BACKGROUND OF THE INVENTION

1. Field of the Invention

The present invention relates to an electronic percussion instrument including an impact sensor which converts vibration of a head being struck with a beater into an electric signal so as to generate an electronic musical sound.

The present application claims priority on Japanese Patent Application No. 2013-49035 and Japanese Patent Application No. 2014-47225, the entire content of which is incorporated herein by reference.

2. Description of the Related Art

Conventionally-known electronic percussion instruments are designed to generate an electronic musical sound based on an electric signal output from an impact sensor which detects vibration of a head being struck with a beater. Patent Literature Document 1 (PLT1) discloses an electronic percussion instrument serving as an electronic bass drum with a circular head, made of an elastic material, whose periphery is engaged with a frame. An impact sensor is attached to the back of a strike area corresponding to the center of a head via a center cushion with an outer periphery encompassed by a ring-shaped damper cushion. A vibrating wave occurs when the strike area of a head is being struck with a beater. A vibrating wave is transmitted toward the periphery of a head, bounced back, and then attenuated by the damper cushion.

The electronic percussion instrument of PLT1 generates an impulsive sound (i.e. a sound directly caused by an impact of a head being struck with a beater) independently of an electronic musical sound which is generated based on an electric signal output from an impact sensor which detects vibration occurring on a head being struck with a beater. Due to an impact of a head, a large vibration occurs in the entirety of the internal area of a head (i.e. an area which exists inwardly of the periphery of a head) compared to the periphery of a head which is fixed to the frame, thus causing a large impulsive sound. A large impulsive sound accompanied with an electronic musical sound is offensive to human's ears, and therefore an impulsive sound may degrade the sound quality of an electronic percussion instrument in terms of articulation.

It is necessary to reduce an impulsive sound accompanied with an electronic musical sound because both the pitch and the tone color of an impulsive sound significantly affect the sound quality of an electronic percussion instrument. For example, it is not preferable for an electronic percussion instrument to generate a high-pitch impulsive sound with a low volume which may degrade sound quality.

CITATION LIST

Patent Literature Document

Patent Literature Document 1: Japanese Patent Application Publication No. 2009-128426

SUMMARY OF THE INVENTION

It is an object of the present invention to provide an electronic percussion instrument which aims to improve sound quality such as articulation by suppressing an impulsive sound which is generated when a head is being struck with a beater.

The present invention is directed to an electronic percussion instrument which generates an electronic musical sound in response to a striking operation applied to a head with a beater.

In a first aspect of the present invention, an electronic percussion instrument includes a frame, a head, an impact sensor, and at least one connecting part. The head is made of an elastic material with a higher flexibility than the frame, wherein the head has a main area including a main strike area, which is disposed in the front side of the frame and which is mainly subjected to a striking operation, and an auxiliary area which includes a fixing part fixed to the frame but does not include the main strike area. The impact sensor converts a vibration occurring on the main strike area subjected to a striking operation into an electric signal. At least part of the main area of the head is connected to the auxiliary area via a connecting part which is reduced in thickness in comparison with the auxiliary area.

In the above, the connecting part is horizontally arranged in at least one of the upper portion above the main area or the lower portion below the main area, wherein the connecting part is linearly elongated across the head. Preferably, the connecting part is made of a groove which is formed in the head. The groove is formed in each of the surface and the back of the head.

In a second aspect of the present invention, an electronic percussion instrument includes a frame, a head, and an impact sensor. The head is made of an elastic material with a higher flexibility than the frame, wherein a main area, including a main strike area which is disposed in the front side of the frame and which is mainly subjected to a striking operation, is connected to an auxiliary area which includes a fixing part fixed to the frame but does not include the main strike area. The impact sensor converts a vibration occurring on the main strike area subjected to a striking operation into an electric signal.

In the above, the main area is horizontally elongated in the head. Preferably, the electronic percussion instrument may further include a vibration-damping member which is made of a harder material than the head and which is disposed in at least one of the front side, the rear side, and the inside of the auxiliary area precluding the main strike area in the head.

In this connection, it is possible to dispose the impact sensor close to the main strike area of the head via a cushion member.

As described above, the present invention demonstrates advantageous effects such as a vibration-damping effect to suppress an impulsive sound at a striking operation on the head being struck with a beater, and an effect to improve sound quality while reducing mechanical noise. Preferably, the electronic percussion instrument of the present invention is applicable to a twin-beater bass drum set.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1A:
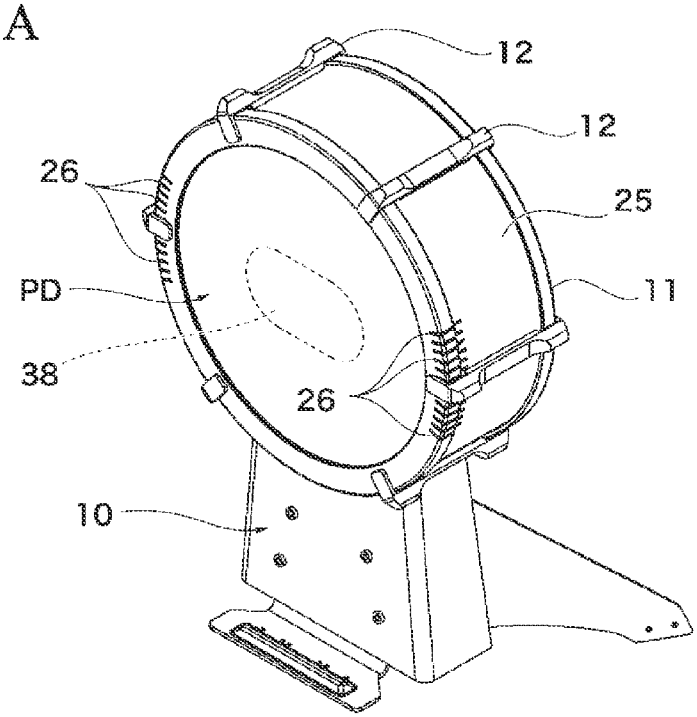
FIG. 1A is a perspective view showing the front side of an electronic percussion instrument according to the preferred embodiment of the present invention.
Figure 1B:
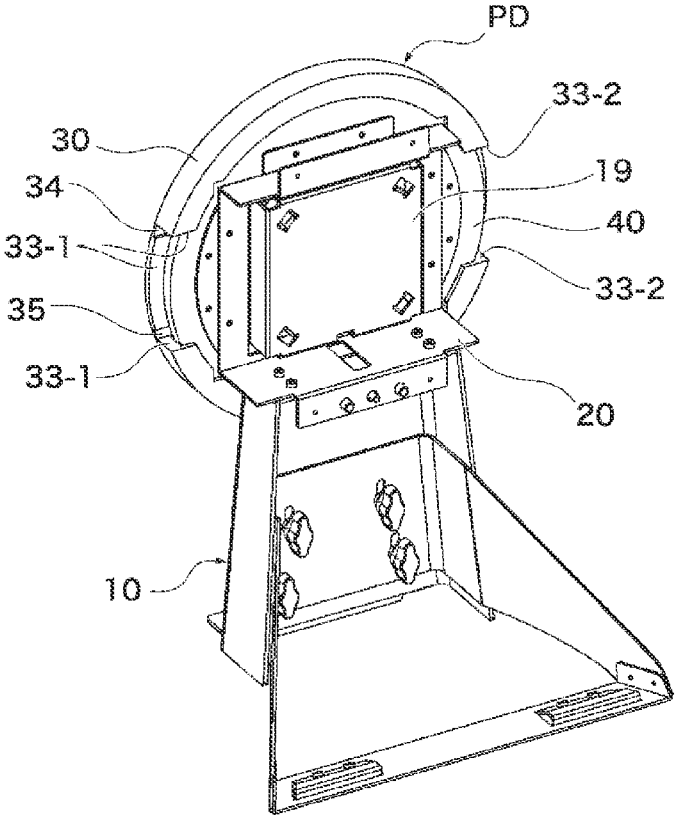
FIG. 1B is a perspective view showing the rear side of the electronic percussion instrument.
Figure 2B:
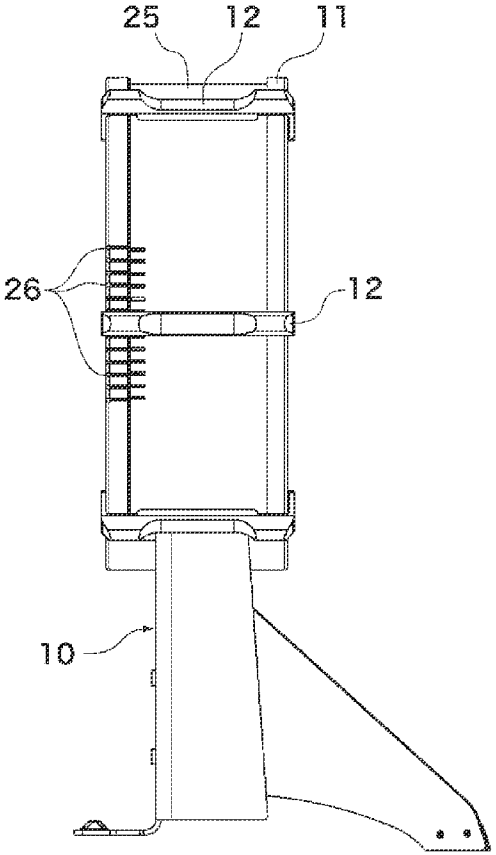
FIG. 2B is a side view of the electronic percussion instrument.
Figure 2A:
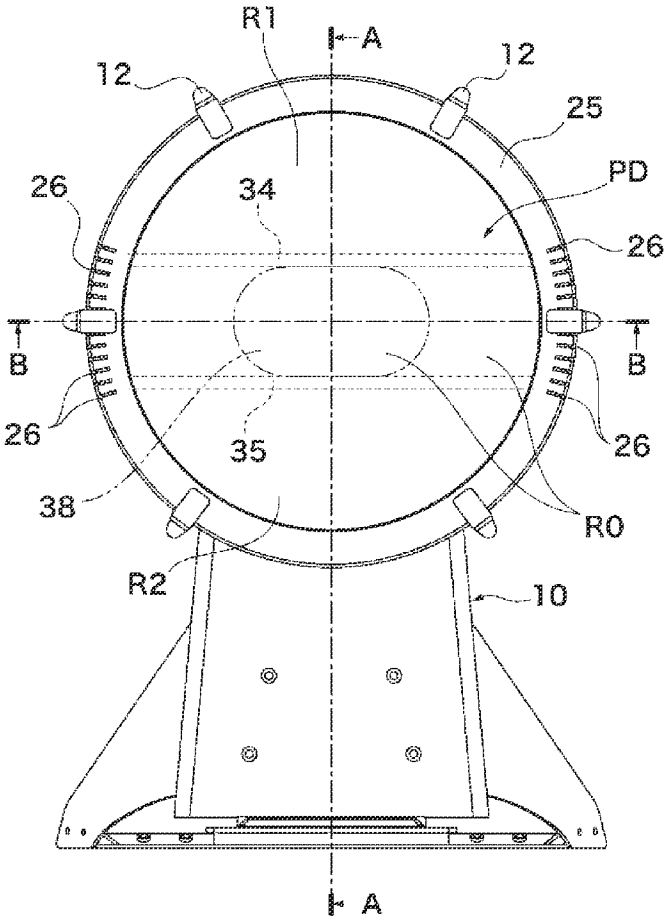
FIG. 2A is a front view of the electronic percussion instrument.

FIG. 1A is a perspective view showing the front side of an electronic percussion instrument according to the preferred embodiment of the present invention, while FIG. 1B is a perspective view showing the rear side of the electronic percussion instrument precluding covers. FIG. 2A is a front view of the electronic percussion instrument, while FIG. 2B is a side view of the electronic percussion instrument.

The electronic percussion instrument of the present embodiment serves as an electronic bass drum in which a main body serving as a kick pad is supported by a stand 10. A foot pedal device (not shown) is additionally attached to the front side of the electronic percussion instrument in proximity to a player (e.g. a drummer) who plays the electronic percussion instrument. For convenience sake, four directions (i.e. UP, DOWN, RIGHT, LEFT) are determined in the player's view, i.e. in the front view of the electronic percussion instrument shown in FIG. 2A. Additionally, two directions (i.e. FRONT, REAR) are determined in the player's view, and therefore the front side matches with the player's side.

It is possible to employ the generally-manufactured product of a foot pedal device, in which a player may operate (or depress) a pedal with his/her foot to strike a circular-shaped pad member PD with a beater (not shown). In this connection, the foot pedal device may include a single beater. The present embodiment is adapted to a twin-beater foot pedal device including two beaters which can be independently operated by a player. For this reason, the circular-shaped pad member PD includes an elliptically-shaped main strike area 38 which can be divided into left and right sides about the center point in the front view in connection with two beaters. That is, the foot pedal device is arranged such that the left and right beaters can strike the left and right sides of the main strike area 38 respectively.

As shown in FIG. 1B, a metal stay 20 is fixed to the upper side of the stand 10. The pad member PD is fixed to the front side of the stay 20 via a flange of a cushion-holding member 19.

Figure 3:
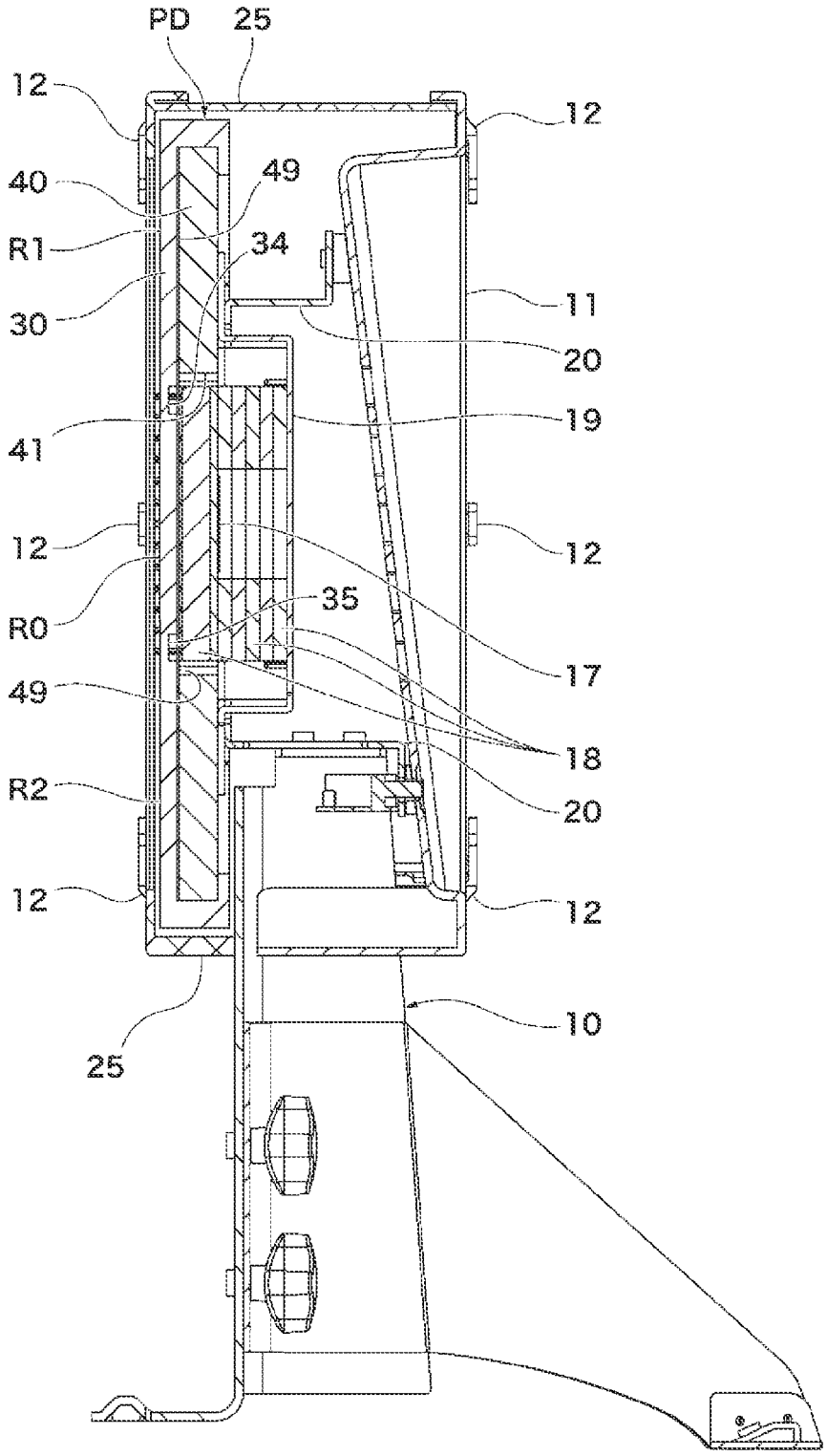
FIG. 3 is a longitudinal sectional view taken along line A-A in FIG. 2A.
Figure 4:
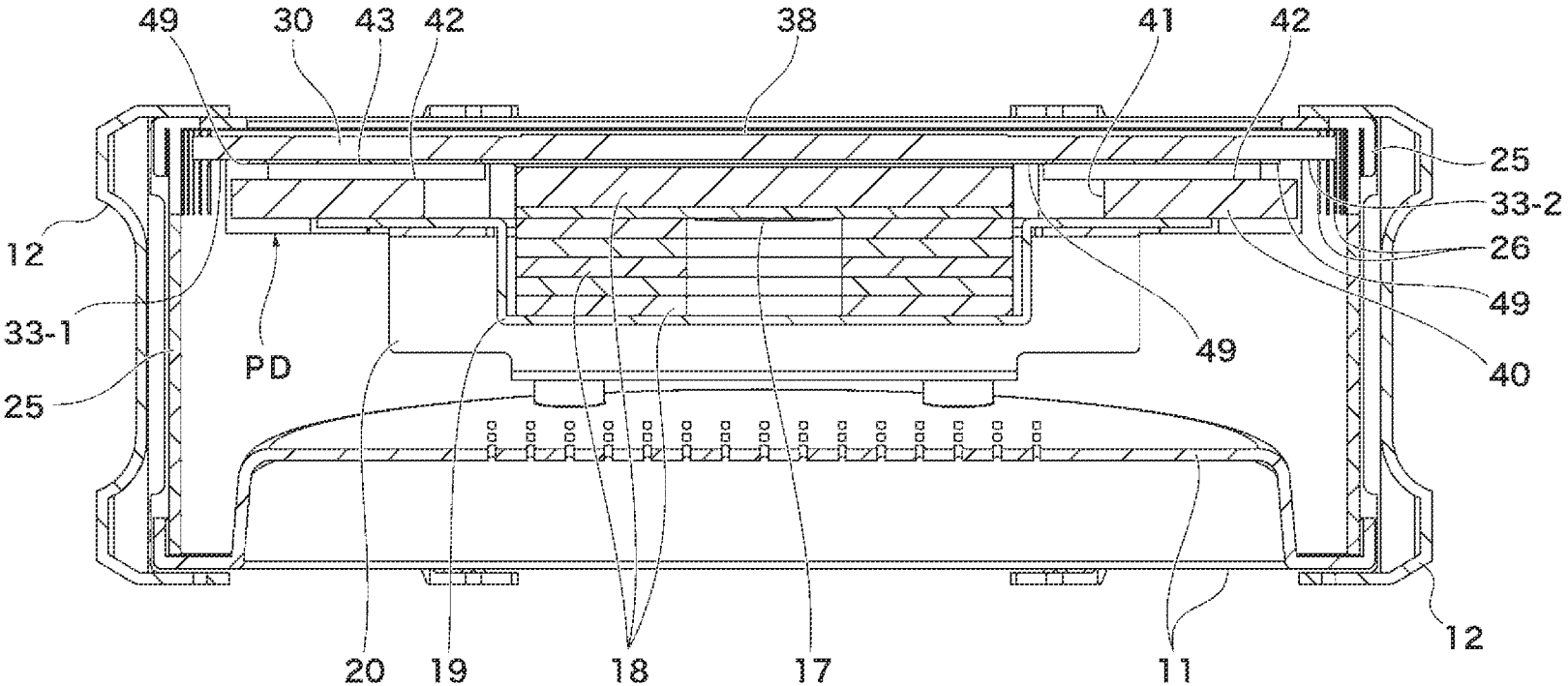
FIG. 4 is a cross-sectional view taken along line B-B in FIG. 2A.

FIG. 3 is a longitudinal sectional view of the electronic percussion instrument along line A-A in FIG. 2A, while FIG. 4 is a cross-sectional view of the electronic percussion instrument along line B-B in FIG. 2A. As shown in FIGS. 3 and 4, a rear cover 11 is fixed to the upper and lower sides of the stay 20 in the rear view. A front cover 25 having a cylindrical shape is fixed to the rear cover 11 by way of six hooks 12 which are separated from each other by equal distances in the circumferential direction of the pad member PD. The external circumference of the pad member PD is entirely covered with the front cover 25.

Next, the details of the pad member PD will be described. The pad member PD includes a head 30 which is integrally formed using an elastic material such as rubber, silicon, and urethane, a frame 40 made of a resin, and a plate 49 made of a hard resin or a metal. The head 30 is made of an elastic material which is softer or more elastic than the material of the frame 40. The plate 49 is made of a material which is harder than the material of the head 30, wherein the plate 49 is a plate member serving as a vibration damper.

Figure 5A:
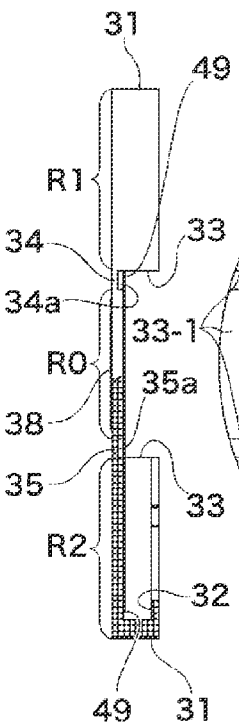
FIG. 5A is a cross-sectional view partly in side section taken along line C-C in FIG. 5B.
Figure 5B:
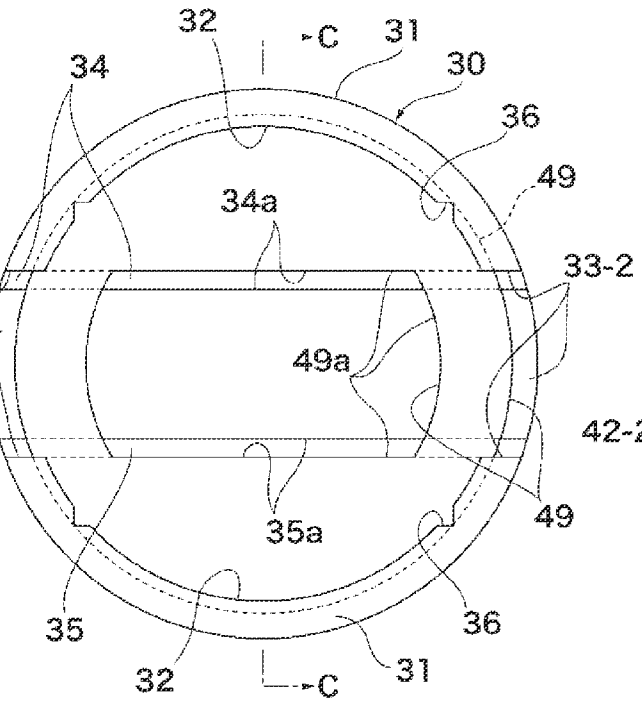
FIG. 5B is a rear view of a plate in the electronic percussion instrument.
Figure 5C:
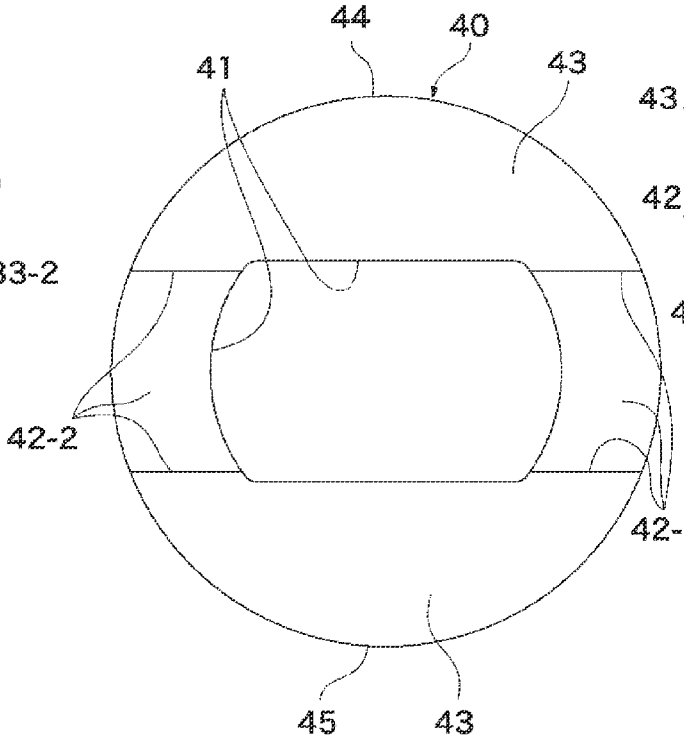
FIG. 5C is a front view of a frame in the electronic percussion instrument.
Figure 5D:
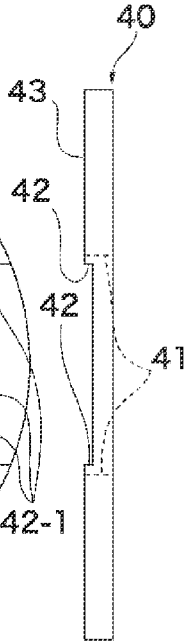
FIG. 5D is a side view of the frame in the electronic percussion instrument.

FIG. 5A is a cross-sectional view of the head 30, while FIG. 5B is a rear view of the plate 49. That is, FIG. 5A is a cross-sectional side view taken along line C-C in FIG. 5B, thus showing a side view partly in cross section. FIG. 5C is a front view of the frame 40, while FIG. 5D is a side view of the frame 40.

As shown in FIGS. 5A and 5B, the head 30 having a circular shape in a front view includes a periphery 31 (i.e. the external circumference of the head 30). The upper and lower parts of the periphery 31 of the head 30 are folded inwardly in the radius direction to form folded parts 32. A pair of linear grooves 34*a*, 35*a* is formed in parallel to horizontally cross the rear face of the head 30 in the left-right direction of FIG. 5B. Specifically, the grooves 34*a* and 35*a* are U-shaped grooves which are formed by partly engraving the rear face of the head 30 by the predetermined depth such that the remaining parts after engraving are used as connecting parts 34 and 35 serving as hinges. A plurality of cutouts 33 (i.e. 33-1 and 33-2) is formed in the periphery 31 of the head 30 at the left and right edges which exist between the connecting parts 34 and 35 in the vertical direction. No cutouts 33 are formed in the folded parts 32 of the periphery 31 of the head 30. Instead, a plurality of notches 36 is formed in the folded parts 32 which are separated from each other in the vertical direction.

The head 30 is uniformly formed with the same thickness except for the folded parts 32 and the connecting parts 34, 35. As shown in FIGS. 2A and 5A, the intermediate area formed between the connecting parts 34 and 35 in the vertical direction is a main area R0 including the main strike area 38 which is actually struck with a beater (or beaters). An upper area R1 is formed above the connecting part 34, while a lower area R2 is formed below the connecting part 35. The upper area R1 and the lower area R2 are auxiliary areas which do not encompass the main strike area 38 of the head 30. The main area R0 is connected to the upper area R1 via the connecting part 34, while the main area R0 is connected to the lower area R2 via the connecting part 35. It is preferable that the maximum thickness of the connecting parts 34, 35 be thinner than the minimum thickness of the auxiliary areas.

As shown in FIG. 5B, the plate 49 is a ring-shaped member with a circular external shape, wherein a horizontally-elongated plate hole 49*a* is formed in the plate 49. The plate 49 is fixed to the rear face of the head 30 by way of the adhesive. When the plate 49 is fixed to the head 30, the upper edge of the plate hole 49*a* matches with the upper edge of the groove 34*a* while the lower edge of the plate hole 49*a* matches with the lower edge of the groove 35*a*.

As shown in FIGS. 5C and 5D, the frame 40 is a ring-shaped member with a horizontally-elongated frame hole 41. The plate hole 49*a* of the plate 40 (see FIG. 5B) is bigger than the frame hole 41 of the frame 40 (see FIGS. 5C, 5D) in the vertical direction and in the horizontal direction. Alternatively, the plate hole 49*a* has the same size as the frame hole 41. The intermediate part of the frame 40 in the vertical direction is recessed in comparison with the upper and lower parts, and therefore a plurality of step differences 42 (i.e. 42-1, 42-2) is formed in the left and right sides of the frame 40. The lower area below the step differences 42 and the upper area above the step differences 42 are larger in thickness than the step differences 42, and therefore the surfaces of the upper and lower areas serve as receiving faces 43 which come in contact with the plate 49. The periphery of the frame 40 is divided into an upper periphery 44 and a lower periphery 45. When the plate 49 is assembled with the frame 40, the cutouts 33-1, 33-2 are positioned to face the step differences 42-1, 42-2 respectively.

The electronic percussion instrument is manufactured by assembling parts in the following manner. First, the stay 20 is fixed to the upper portion of the stand 10 via screws (see FIG. 1B). A plurality of cushion layers 18 which are laminated in the front-rear direction is attached to the cushion-holding member 19, wherein an impact sensor 17 made of a piezoelectric sensor is interposed between the cushion layers 18 which are laminated in the front-rear direction (see FIGS. 3, 4). Together with the stay 20, the flange of the cushion-holding member 19 is fixed to the rear face of the frame 40 of the pad member PD via screws (see FIG. 1B). In the process of fixing the stay 20 and the cushion-holding member 19 to the frame 40, it is possible to use the frame 40 independently of associated parts. Alternatively, it is possible to use the pad member PD which is already furnished with the frame 40 in advance.

The pad member PD is produced by assembling parts in the following manner. First, it is necessary to prepare an intermediate product in which the plate 49 is adhered to the rear face of the head 30 (see FIG. 5B). The rear side of the intermediate product is positioned opposite to the surface of the frame 40 such that the plate hole 49*a* matches with the frame hole 41 (see FIG. 5C) in precise positioning. The folded parts 32 of the periphery 31 of the head 30 are engaged with the peripheries 44, 45 of the frame 40 such that the folded parts 32 are externally covered with the peripheries 44, 45 respectively. Due to the formation of the cutouts 33 and the notches 36 in the plate 49, it is easy for a worker to engage the folded parts 32 of the head 30 with the peripheries 44, 45 of the frame 40.

Thus, it is possible to completely produce the pad member PD when the head 30 is assembled with the frame 40, wherein the upper and lower parts of the plate 49 are brought in contact with the receiving faces 43 of the frame 40. Additionally, a protective material having flexibility such as a knitted material is attached to entirely cover the front face of the head 30. A space is formed between the cutout 33-1 and the step difference 42-1 in the front-rear direction while another space is formed between the cutout 33-2 and the step difference 42-2. Those spaces are air vents which are formed in the left and right sides of the pad member PD so as to communicate with the external air (see FIG. 1B and FIG. 4).

As shown in FIGS. 3 and 4, a part of the cushion layers 18 is introduced into the frame hole 41 such that the front face of the cushion layers 18 comes in contact with the rear face of the head 30 (in particular, the rear face of the main strike area 38) when the stay 20 and the cushion-holding member 19 are fixed to the pad member PD.

Next, the rear cover 11 is fixed to the upper rear part and the lower rear part of the stay 20 via screws. The periphery of the front cover 25 is engaged with the inside of the edge of the rear cover 11, and then the rear cover 11 and the front cover 25 are assembled together by use of the six hooks 12 in the front-rear direction. Then, a plurality of screws is applied to the rear parts of the hooks 12, which are thus attached to the rear side of the rear cover 11. Herein, the distal ends of screws press the rear cover 11 in the forward direction, while the front parts of the hooks 12 press the front cover 25 in the backward direction. Thus, it is possible to firmly attach the front cover 25 to the rear cover 11.

It is important in the present embodiment that the front cover 25 entirely covers the external periphery of the pad member PD but that the front cover 25 does not come in direct contact with the pad member PD. In other words, the pad member PD is supported by the stand 10 via the stay 20, but the front cover 25 does not at all contribute to the support of the pad member PD. In this connection, the present embodiment is not necessarily limited to the foregoing method of fixing the rear cover 11 and the front cover 25; hence, the hooks 12 are not essential to the present embodiment. It is possible to employ an integrally-unified cover which unifies the rear cover 11 and the front cover 25. A plurality of slits 26 is formed in the left and right sides of the front cover 25 at the predetermined positions which match with the positions of the cutouts 33 and the positions of the step differences 42 (see FIG. 1A and FIG. 2).

In the present embodiment adopting a twin-beater foot pedal device, the main strike area 38 is a horizontally-elongated elliptical shape as shown in FIGS. 1A and 2A. As described above, a knitted material is adhered to the surface of the head 30, whereas the following description does not necessarily discriminate the knitted material and the surface of the head 30.

Vibration occurs on the head 30 when the main strike area 38 of the head 30 is struck with a beater. Vibration of the head 30 is transmitted to the impact sensor 17 via the foremost layer of the cushion layers 18. The impact sensor 17 converts vibration into an electric signal (e.g. an electric voltage), which is output as a detection signal. The electronic percussion instrument detects a striking operation applied to the head 30 with a beater when the detection signal exceeds the predetermined threshold. Based on the detection result, the electronic percussion instrument produces a musical sound with a volume corresponding to the detection signal at the timing of detecting a striking operation by way of a musical sound generating system (not shown).

The present embodiment is characterized by implementing a countermeasure to reduce an impulsive sound when a beater strikes the head 30. An impulsive sound is a mechanical sound which is generated independently of an electronic musical sound, which is electronically generated based on a detection signal of the impulse sensor 17, when a beater strikes the head 30. In the conventional structure in which the periphery of the head 30 is entirely fixed to the periphery of the frame 40, the internal area of the head 30 in the radius direction is entirely vibrated due to a striking operation on the head 30 with a beater; this may rapidly increase the back pressure of the head 30. Due to this phenomenon, the conventional structure suffers from a large impulsive sound which occurs mechanically due to a striking operation on the head 30 with a beater. The present embodiment aims to reduce or suppress an impulsive sound and to improve a tone color by introducing the grooves 34*a*, 35*a* and the cutouts 33 in the head 30 as well as the plate 49.

Figure 9:
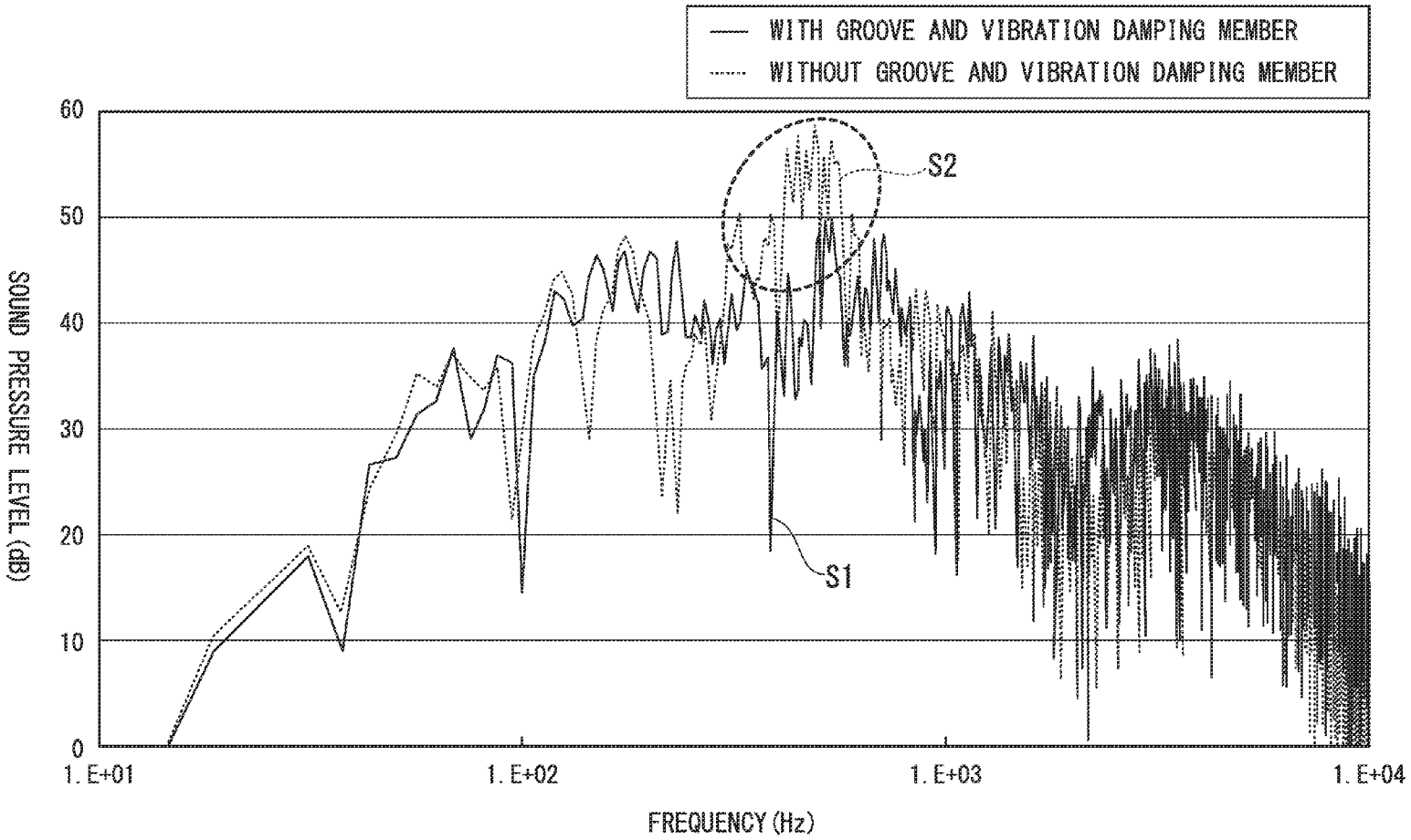
FIG. 9 is a graph showing frequency characteristics of impulsive sounds with or without a vibration-damping member and a groove in the back of the head in the electronic percussion instrument.

FIG. 9 shows frequency characteristics of impulsive sounds S1, S2, wherein the impulsive sound S1 is measured with the head structure including a groove and a vibration-damping member in the back of the head, while the impulsive sound S2 is measured with the head structure precluding a groove and a vibration-damping member. As shown by a dotted circle in FIG. 9, the peak portion of the impulsive sound S1 is significantly attenuated in sound pressure in comparison of the peak portion of the impulsive sound S2. This demonstrates an advantageous effect of the present embodiment including a groove and a vibration-damping member in the back of the head in terms of frequency characteristics and noiselessness.

In the head 30 (see FIGS. 5A and 5B), the main area R0 is connected to the upper area R1 and the lower area R2 via the connecting parts 34 and 35 which are thinned in thickness. Due to the connectors connecting parts 34 and 35 serving as hinges, the head 30 is not uniformly vibrated at a striking operation on the head 30 with a beater, but the main area R0 is relatively vibrated about the connecting parts 34 and 35 serving as the oscillating points for the upper area R1 and the lower area R2. This reduces the vibrating area in the head 30 so as to reduce an impulsive sound in volume. Additionally, the thickness of the main area R0 is not smaller than the thickness of the connecting parts 34 and 35; this may not increase the pitch of an impulsive sound, thus improving sound quality while reducing mechanical noise.

Due to the formation of the cutouts 33 in the left and right sides in the periphery 31 of the head 30, even when the back pressure of the head 30 is varied due to vibration of the head 30 at a striking operation, air may pass through the cutouts 33 so as to alleviate variations of the back pressure of the head 30. Additionally, the step differences 42 of the frame 40 cooperate with the cutouts 33 to form air ventilation, thus smoothing the inlet and outlet of air in the head 30 while reducing mechanical noise.

It is necessary to arrange at least one cutout 33 serving as an air vent in the periphery 31 of the head 30, and it is preferable to arrange a plurality of cutouts 33 in order to achieve efficient air ventilation. In particular, it is preferable to arrange a pair of cutouts 33 which are disposed opposite to each other with the maximum distance therebetween in the circumferential direction in terms of effective air ventilation. In the present embodiment, the left-side cutout 33-1 is positioned opposite to the right-side cutout 33-2 by way of the main area R0; but this is not a restriction. It is possible to divide the circular-shaped head 30 into a pair of semicircular sections, each of which may arrange at least one air vent. In this connection, it is possible to secure a high air-ventilation effect on the condition that distance between the opposite position of the cutout 33-1 and the cutout 33-2 is shorter than the distance between the cutouts 33-1 and 33-2.

The front cover 25 includes a plurality of slits 26 which are positioned at the same positions as the cutouts 33 and the step differences 42 in the circumferential direction of the head 30. Thus, it is possible to cover the head 30 with the front cover 25 without reducing air ventilation via the cutouts 33 and the step differences 42.

The electronic percussion instrument may be degraded in terms of the precision of detecting a striking operation on the head 30 with a beater due to vibration which is continued for a relatively long time due to a large vibration applied to the entirety of the head 30. To overcome this event, the present embodiment introduces the hard plate 49 which encompasses the main strike area 38 in the head 30. Thus, it is possible to suppress a large vibration which occurs on the head 30 being struck with a beater, and therefore it is possible to attenuate vibration and to improve the precision of detecting a striking operation. Additionally, it is possible to reliably reduce an impulsive sound, which is mechanically generated when the head 30 is struck with a beater, due to vibration suppression. In particular, the present embodiment demonstrates a high vibration-damping effect due to close adherence of the plate 49 to the frame 40. Additionally, the present embodiment demonstrates a high vibration-damping effect in all the radius directions about the main strike area 38 due to the seamless ring-shape of the plate 49. On the other hand, the present embodiment does not degrade a player's sensation to strike the head 30 with a beater since the plate 49 does not interfere with the main strike area 38.

Due to the formation of the "thinned" connecting parts 34 and 35 in the head 30, it is possible to suppress an impulsive sound (i.e. a mechanical sound which occurs when the head 30 is struck with a beater) and to improve sound quality while reducing mechanical noise. Due to the formation of the cutouts 33 and the step differences 42 at the predetermined positions which do not interfere with the main area R0 including the main strike area 38, it is possible to easily vent air in the back of the head 30 being struck with a beater, thus improving sound quality while reducing mechanical noise. Due to the arrangement of the plate 49, it is possible to suppress vibration which occurs on the head 30 being struck with a beater, thus reducing an impulsive sound and improving the precision of detecting a striking operation on the head 30.

The present embodiment is characterized in that the connecting parts 34 and 35 are horizontally and linearly elongated while the main area R0 is laterally elongated. Additionally, the main strike area 38 of the head 30 is encompassed by the plate 49 in conformity with the plate hole 49*a*, and therefore the main strike area 38 is laterally elongated. Thus, the electronic percussion instrument of the present embodiment demonstrating a vibration-damping effect is applicable to a twin-beater bass drum set.

When the frame 40 is fixed in position by way of the periphery 31 of the head 30, the peripheries 44 and 45 of the frame 40 are externally covered with the folded parts 32 of the periphery 31, and therefore the frame 40 is firmly attached to the head 30. Due to the formation of the cutouts 33 in the periphery 31 of the head 30, it is easy for a worker to fix the position of the frame 40 such that folded parts 32 are wound about the peripheries 44 and 45. In particular, the cutouts 33 are formed in proximity to the left and right ends of the connecting parts 34 and 35 in connection with the periphery 31 of the head 30 close to the main area R0. This makes it easy for a worker to process the cutouts 33 and the connecting parts 34, 35. In other words, the present embodiment is advantageous in terms of the manufacturing of the head 30 applicable to a twin-beater bass drum set.

It is possible to create various types of the head 30, each of which is able to suppress an impulsive sound when the head 30 is struck with a beater. Variations of the head 30 will be described with reference to FIGS. 6A to 6E.

Figure 6A:
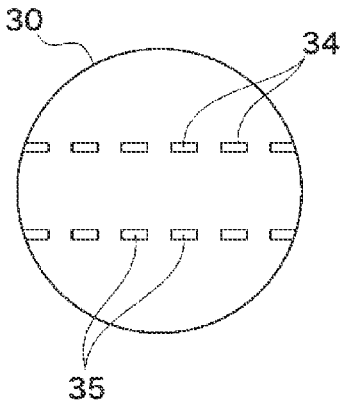
FIG. 6A is a front view showing a first variation of the head in the electronic percussion instrument.
Figure 6B:
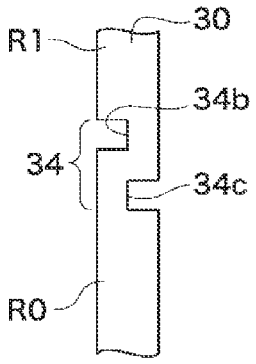
FIG. 6B is a side view showing a second variation of the head in the electronic percussion instrument.

It is not essential to continuously form the connecting parts 34, 34 and the grooves 34*a*, 35*a*, which can be intermittently disconnected. FIG. 6A shows a first variation of the head 30 in which the connecting parts 34 and 35 are each intermittently disconnected at various points, which can demonstrate a mechanical noise suppression effect as well. Additionally, it is not essential to form one connecting part (e.g. the connecting part 34) as a single groove, and therefore the connecting part can be redesigned such that the front and rear sides thereof are alternatively recessed in the head 30. FIG. 6B shows a second variation of the head 30 in which the connecting part 34 is configured of a pair of grooves 34*b* and 34*c* which are positioned adjacent to each other and which are alternatively recessed on the front and rear sides. The other connecting part 35 can be redesigned in a similar manner to the connecting part 34. It is necessary for the connecting parts 34 and 35 to be reduced in thickness in comparison with the upper area R1 and the lower area R2. In this connection, the connecting parts 34 and 35 are not necessarily shaped like grooves, and therefore they can be formed in other shapes. Additionally, the connecting parts 34 and 35 are not necessarily formed in linear shapes; hence, they can be formed in S-shapes or curved shapes.

Figure 6C:
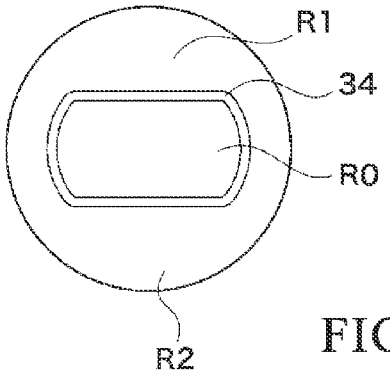
FIG. 6C is a front view showing a third variation of the head in the electronic percussion instrument.

It is not necessary to form two connecting parts 34 and 35; hence, a single connecting part may sufficiently demonstrate a mechanical noise suppression effect. FIG. 6C shows a third variation of the head 30 with a single ring-shaped connecting part 34. The main area R0 is encompassed inside the ring-shaped connecting part 34, while the auxiliary areas (i.e. the upper area R1 and the lower area R2) are positioned outside the ring-shaped connecting part 34. The main area R0 and the auxiliary areas are connected together via the "thinned" ring-shaped connecting part 34.

Figure 6D:
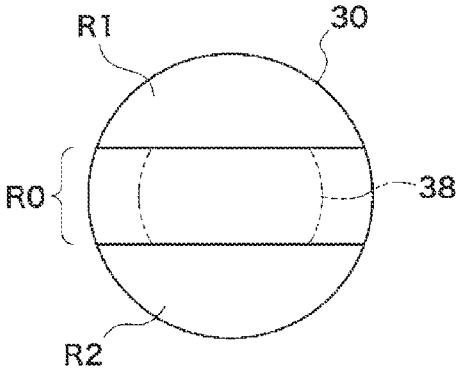
FIG. 6D is a front view showing a fourth variation of the head in the electronic percussion instrument.

In the present embodiment, the head 30 is designed such that the main area R0 and the auxiliary areas (i.e. the upper area R1 and the lower area R2) are connected together via the connecting parts 34 and 35; but this is not a restriction. The connecting parts 34 and 35 need to be reduced in thickness in comparison with the auxiliary areas; hence, it is possible to redesign the head 30 such that all the main area R0 and the connecting parts 34, 35 have the same thickness. FIG. 6D shows a fourth variation of the head 30 in which the main area R0 is reduced in thickness in comparison with the auxiliary areas such that the connecting parts 34 and 35 cannot be visibly recognized as constituent elements in the main area R0. This structure can be regarded such that the main area R0 is directly connected to the auxiliary areas. Strictly speaking in terms of the thickness, the maximum thickness of the main area R0 is smaller than the minimum thickness of the auxiliary areas.

Figure 6E:
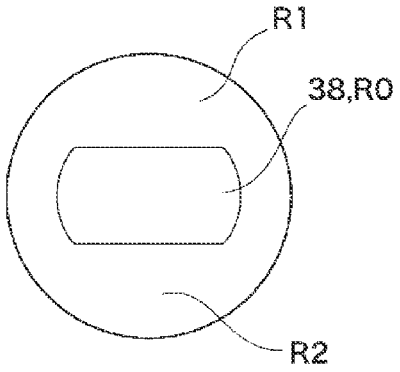
FIG. 6E is a front view showing a fifth variation of the head in the electronic percussion instrument.

FIG. 6E shows a fifth variation of the head 30 in which the main strike area 30 is solely reduced in thickness rather than the other areas such that the main strike area 30 will match with the main area R0. In this structure, the main area R0 is encompassed by the ring-shaped auxiliary area (serving as the upper area R1 and the lower area R2).

As described above, the above variations of the head 30 shown in FIGS. 6A to 6E are able to suppress an impulsive sound which occurs when the head 30 is being struck with a beater, thus improving sound quality while reducing mechanical noise.

In terms of suppression of vibration at a striking operation, it is necessary for the plate 49 (serving as a vibration-damping member) to encompass the main strike area 38 (or to sandwich the main strike area 38) in the plane parallel to the striking surface of the head 30. For this reason, it is not necessary to form the plate 49 in a complete ring-shape. Variations of the plate 49 will be described with reference to FIGS. 7A to 7C.

Figure 7A:
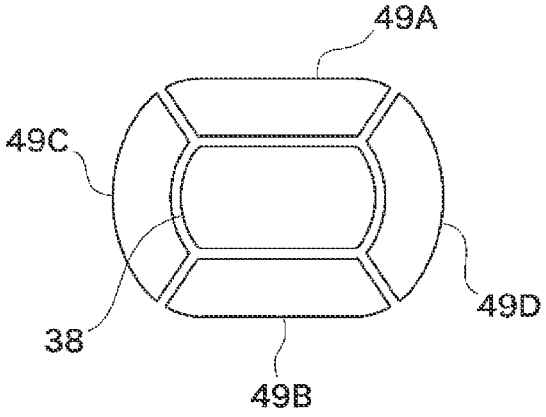
FIG. 7A is a front view showing a first variation of the plate in connection with the head in the electronic percussion instrument.
Figure 7B:
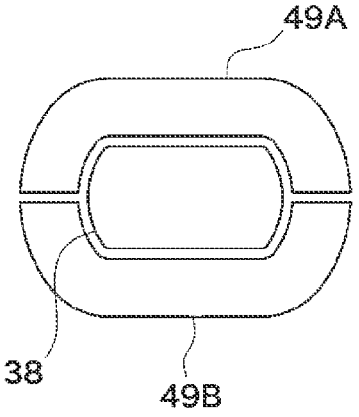
FIG. 7B is a front view showing a second variation of the plate in connection with the head in the electronic percussion instrument.
Figure 7C:
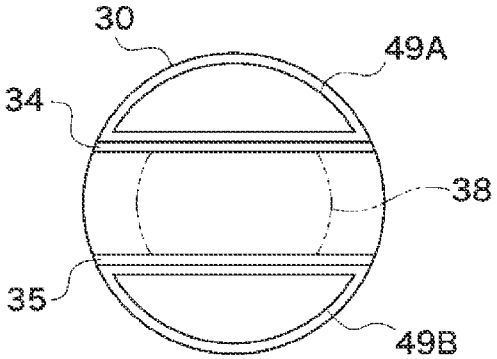
FIG. 7C is a front view showing a third variation of the plate in connection with the head in the electronic percussion instrument.

FIG. 7A shows a first variation of the plate 49 which is divided into a plurality of plates 49A to 49D which are arranged adjacent to each other around the main strike area 38 in the circumferential direction with gaps therebetween. FIG. 7B shows a second variation of the plate 49 which is vertically divided into a pair of plates 49A and 49B which are arranged to encompass the main strike area 38. FIG. 7C shows a third variation of the plate 49 which is separately divided into an upper plat 49A above the connecting part 34 and a lower plate 49B below the connecting part 35.

In either case, the plate 49 is arranged in the area precluding the main strike area 38, whereas the plate 49 is not necessarily arranged in the rear side of the head 30 but can be arranged in the front side of the head 30 or in the inside area of the head 30. Alternatively, the plate 49 can be arranged in at least one of the rear side, the front side, and the inside area of the head 30. Additionally, it is possible to arrange the plate 49 in both the front side and the rear side of the head 30. In this connection, the plate 49 is not necessarily adhered to the head 30 but can be inserted into the head 30 by way of the insert molding. To increase a vibration-damping effect, it is necessary to closely adhere the plate 49 to the frame 40, whereas it is not necessary to directly attach the plate to the frame 40. Similar to the insert molding in which the plate 49 is inserted in the head 30, it is possible to indirectly attach the plate 49 to the frame 40.

Figure 8A:
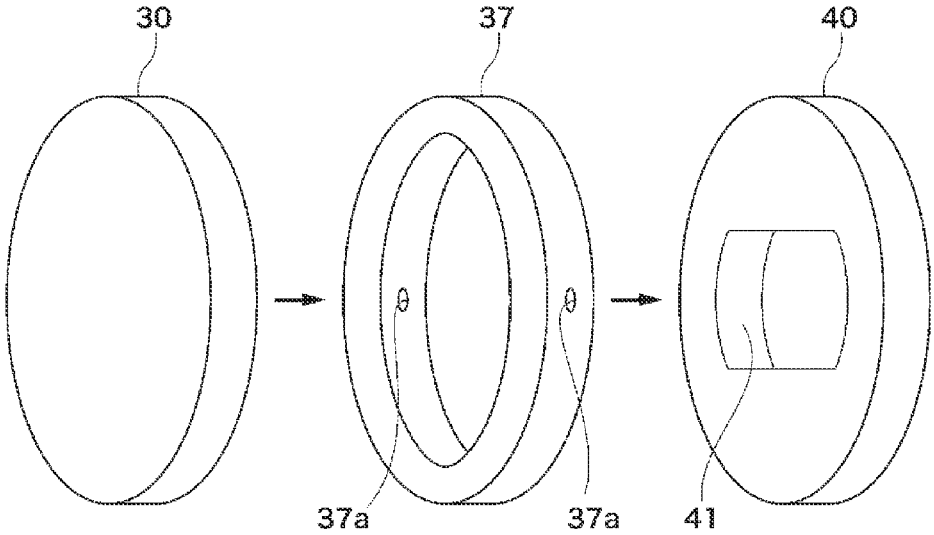
FIG. 8A is an exploded perspective view showing a modified example of a pad member in which the head is connected to the frame via a joint member.
Figure 8B:
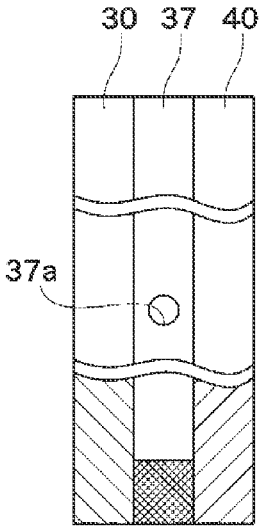
FIG. 8B is a cross-sectional view showing the modified example of the pad member including the head, the joint member with a through-hole, and the frame.

In this connection, a part of the frame 40 which is attached to the periphery 31 of the head 30 will be referred to as a head mount portion, which corresponds to the peripheries 44 and 45 of the frame 40. It is not essential that the periphery 31 of the head 30 be directly attached to the frame 40. FIGS. 8A and 8B show a modified example of the pad member PD in which the periphery 31 of the head 30 is connected to the head mount portion of the frame 40 via a ring-shaped joint member 37 which is arranged independently of the head 30 and the frame 40. In this structure, the frame 40 is not necessarily formed in a circular shape, and therefore the frame 40 can be increased in size to be larger than the head 30. For convenience sake, FIGS. 8A and 8B preclude the illustration of the plate 49.

For the purpose of air ventilation in the back of the head 30 at a striking operation, it is necessary for the present embodiment to form the cutouts 33 of the head 30 and the step differences 42 of the frame 40 as air vents which allow air to pass therethrough at a striking operation of the head 30; but this is not a restriction. To provide a sufficient air ventilation effect, it is necessary to arrange an air vent in at least one of the periphery 31 of the head 30, the joint member 37, and the head mount portion of the frame 40.

Figure 8C:
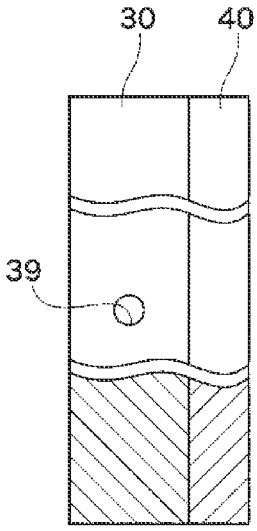
FIG. 8C is a cross-sectional view showing a further modified example of the pad member including the head with a through-hole, and the frame.
Figure 8D:
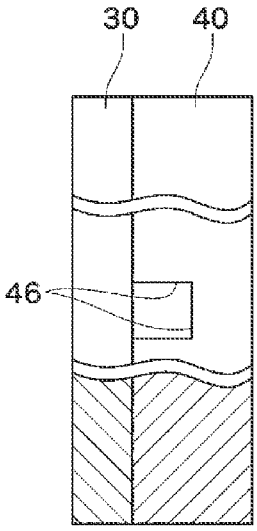
FIG. 8D is a cross-sectional view showing a further modified example of the pad member including the head and the frame with a cutout.

In the structure shown in FIGS. 8A and 8B, for example, it is necessary to form a through-hole 37*a* serving as an air vent at one position in the external periphery of the ring-shaped joint member 37. It is possible to preclude the joint member 37 as shown in FIG. 8C, in which a through-hole 39 serving as an air vent is formed instead of the cutout 33 in the head 30. Alternatively as shown in FIG. 8D, it is possible to form a cutout 46 serving as an air vent in the frame 40. In this connection, it is possible to arbitrarily combine the through-holes 37*a*, 39 and the cutout 46, which can be formed by way of the mechanical molding or the metal molding.

Figure 10C:
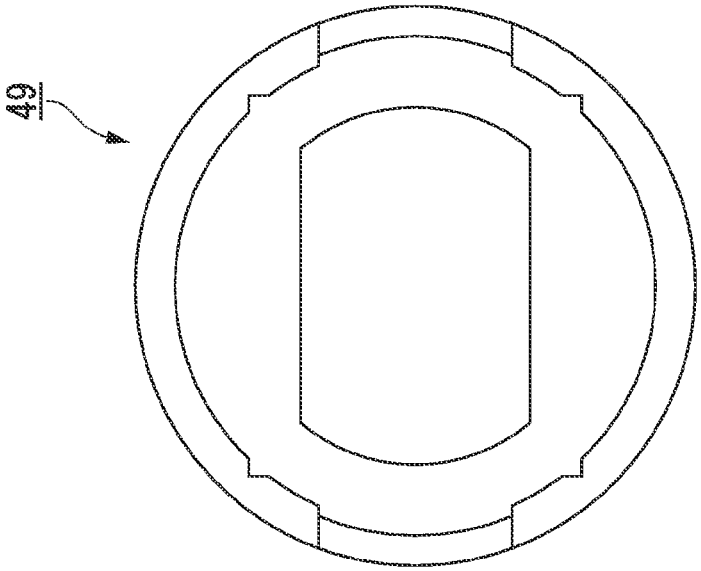
FIG. 10C is a rear view of a further variation of a plate made of an iron serving as a vibration-damping member, the front side of which is covered with the head of FIG. 10A in an electronic percussion instrument.
Figure 10B:
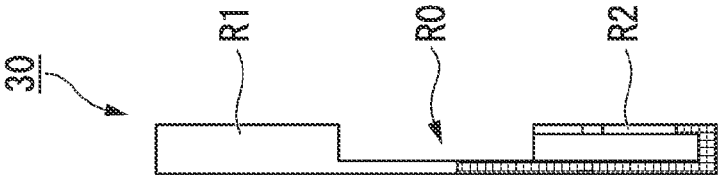
FIG. 10B is a cross-sectional view partly in side section of the further variation of the head shown in FIG. 10A.
Figure 10A:
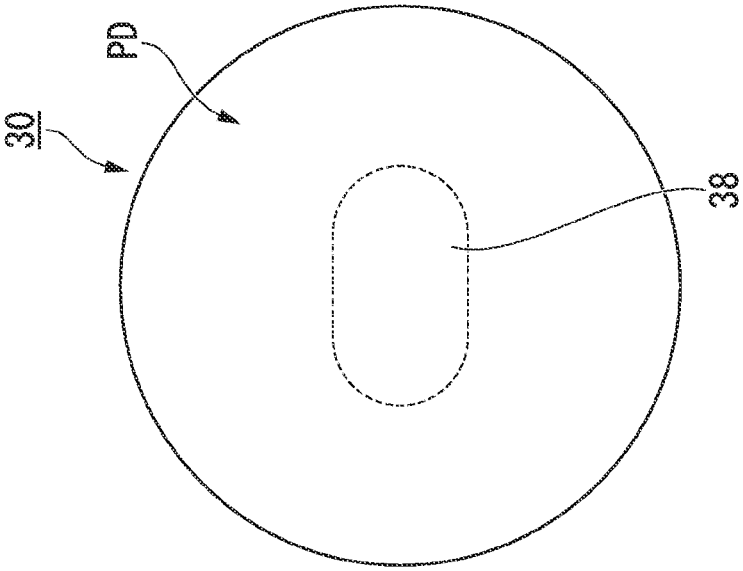
FIG. 10A is a front view showing a further variation of a head made of rubber in an electronic percussion instrument.

The present embodiment employs the plate 49 having the connecting parts 34, and the grooves 34*a*, 35*a*; but this is not a restriction. It is possible to redesign the plate 49 without forming the grooves 34*a*, 35*a*. FIGS. 10A to 10C show a further variation of the plate 49, precluding the grooves 34*a*, 35*a*, which is covered with the head 30 in an electronic percussion instrument. FIG. 10A is a front view of the head 30 in which the main strike area 38 is simply arranged in the center area of the pad member PD made of rubber, and FIG. 10B is a side view of the head 30 which is divided into the main area R0 and the auxiliary areas R1, R2. FIG. 10C is a rear view of the plate 49 made of an iron, in which no grooves are formed between the main area R0 and the auxiliary areas R1, R2. The center area of the plate 49 corresponding to the main area R0 of the head 30 is reduced in thickness in comparison with the peripheral area of the plate 49 corresponding to the auxiliary areas R1, R2 of the head 30, thus reducing a vibration from being transmitted on the entire surface of the head 30.

Noticeably, no conventional arts are designed to provide air ventilation in the back of a head of an electronic percussion instrument. The present embodiment is characterized by employing a unique structure in which the cutouts 33 and the grooves 34 formed in the back of the head 30 cooperate with the step differences 42 formed in the frame 40 so as to secure adequate air ventilation in the back of the head 30, thus reliably securing noiselessness while reducing noise due to an impact on the head 30 in playing the electronic percussion instrument. As shown in FIGS. 10A-10C, it is not necessary to form the grooves 34 in the back of the head 30, but the grooves 34 may create a synergy effect of damping vibration which may be transmitted to the peripheral area about the strike area of the head 30.

Figure 11A:
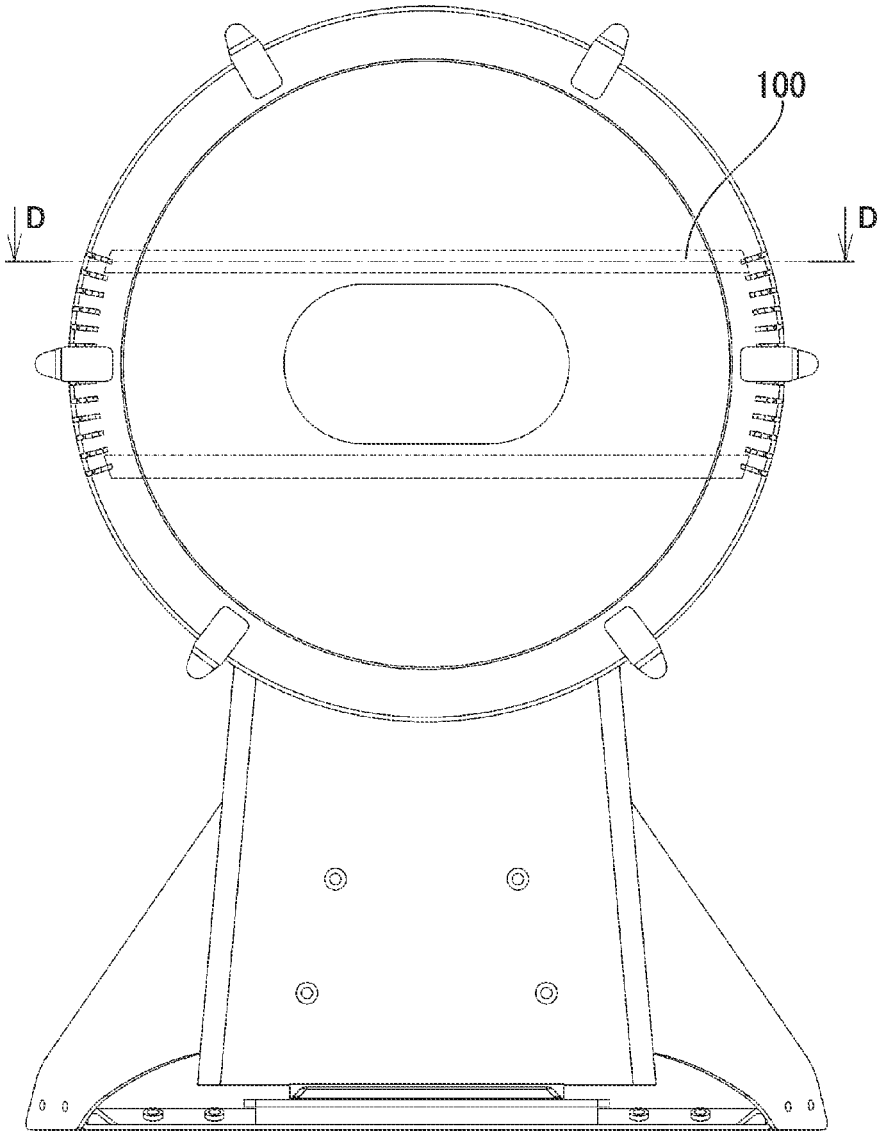
FIG. 11A is a front view of an electronic percussion instrument which is used to illustrate the technical feature of the present invention.
Figure 11B:
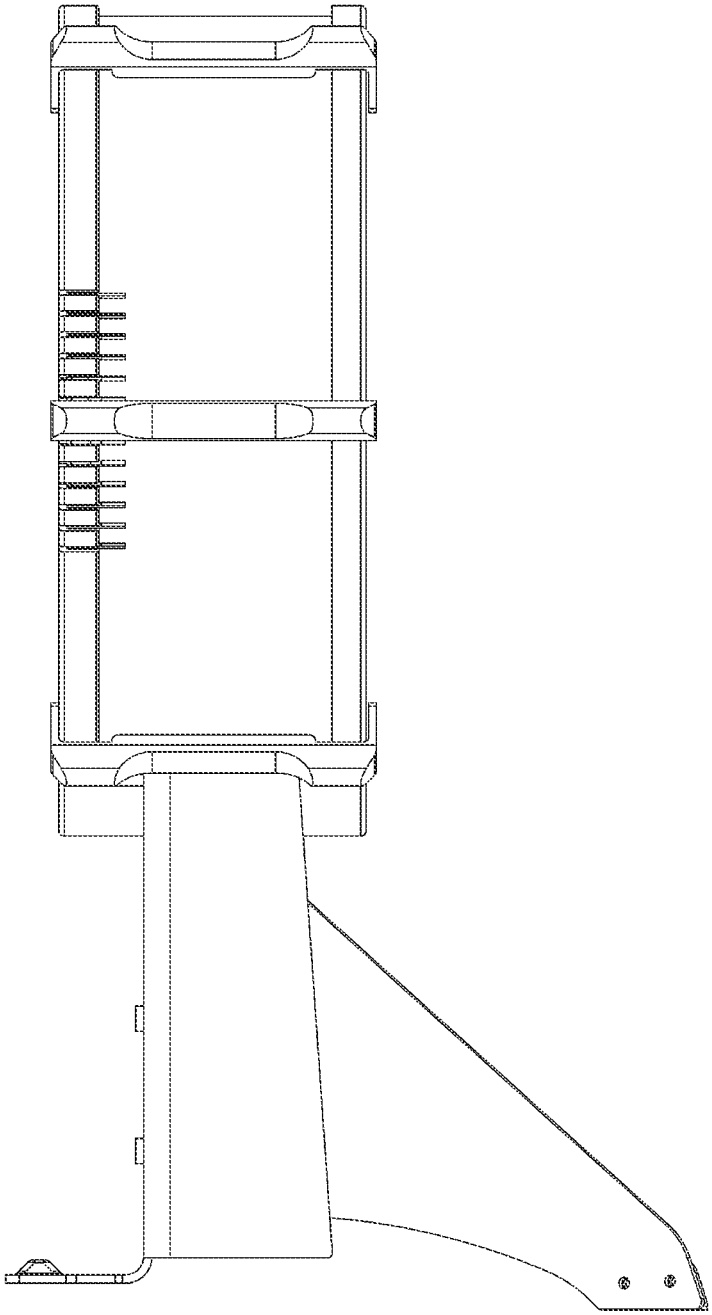
FIG. 11B is a side view of the electronic percussion instrument of FIG. 11A.
Figure 11C:
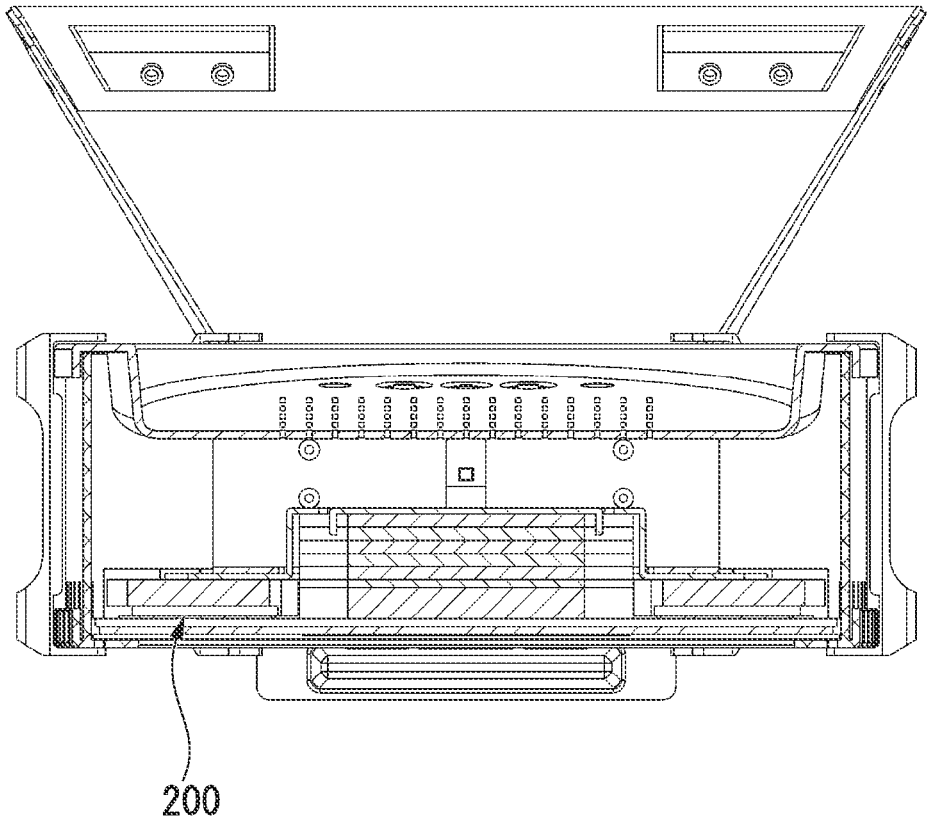
FIG. 11C is a cross-sectional view taken along line D-D in FIG. 11A in view of the upper side of the electronic percussion instrument of FIG. 11A.

FIGS. 11A to 11C show an electronic percussion instrument equipped with the technical feature of the present invention. As shown in FIG. 11A, the head is furnished with a rubber pad having a strike area while a groove 100 is formed in the back of the head. As shown in FIG. 11C which is a cross-sectional view taken along line D-D in FIG. 11A in view of the upper side of an electronic percussion instrument, an air ventilation mechanism 200 is formed via a clearance gauge between the groove 100 of the rubber pad and a hard material which supports the back of the head. The present invention is characterized by the air ventilation mechanism 200 which aims to release air from the back of the head being struck with a beater, thus reliably securing noiselessness while reducing noise due to an impact on the head.

Lastly, the present invention is not necessarily limited to the foregoing embodiment and variations, which can be further modified in various ways within the scope of the invention as defined by the appended claims. The technical features of the present invention can be summarized as follows.

(1) The electronic percussion instrument provides a kick pad device with a strike area being struck with a beater. The head of the electronic percussion instrument is coupled with the frame which is used to fix and adjust the position of a kick pedal device having a beater.

(2) The back of the head may include the "thinned" areas which are vertically arranged above and below the strike area, and therefore the strike area can be laterally elongated in association with a twin-beater foot pedal device whose beaters are laterally aligned together.

(3) The back of the head may include the "thinned" areas in the left and right sides of the strike area. Alternatively, the head may include the "thinned areas" which are arranged in the left and right sides of the strike area as well as in the upper and lower sides of the strike area.

(4) The thinned area may be a groove such as a rectangular recess which is formed in the back of the head. The groove may easily indicate the boundary between the strike area and the non-strike area, which can be discriminated with ease. The thinned area of the head may be easily damaged due to expansion and contraction in comparison with the other "thick" area of the head. To prevent the thinned area of the head from being carved or damaged, it is necessary to arrange an iron reinforcing member outside the thinned area of the head, wherein the reinforcing member should be brought in contact with the structure encompassing the strike area of the head. Additionally, it is necessary to form the bent portion(s) to enclose the frame to be attached to the periphery of the head. In this connection, the thinned area of the head is not necessarily limited to a groove, and therefore it can be formed as a flat thinned area.

(5) Each of the strike area, the thinned area (or the groove), and the external area (or the thick area) of the head is uniformly formed with the predetermined thickness. For example, the strike area of the head is set to 7 mm in thickness; the thinned area (or the groove) of the head is set to 5 mm in thickness; and the external area of the head is set to 7 mm in thickness.

(6) The strike area of the head is formed with a flat surface but with an irregular back having irregularities which are varied in thickness. Due to the formation of irregularities in the back of the head, it is possible to secure an adequate durability in the strike area of the head. Alternatively, it is possible to form irregularities in the surface of the strike area of the head. Basically, the strike area of the head needs to be formed with the flat surface having the same height, but it is possible to redesign the head to have irregularities in both the surface and the back of the head because the present invention may embrace the strike area of the "rubber" head precluding the surface protective material. For example, it is possible to form S-shaped recesses or corrugated recesses (or the continuum of S-shaped recesses) in both the surface and the back of the head.

(7) The strike area and the thinned area (e.g. the groove) of the head are not necessarily manufactured by way of the close adhesion of other members or the insert molding using other members, whereas the external area of the head can be reinforced using hard members. Thus, it is possible to degrade a player's sensation to strike the head with a beater since no hard members are arranged in the strike area of the head as well as the expanded area of the head which may be expanded due to a striking operation. Hard members attached to the external area of the head may demonstrate an effect to prevent excessive vibration on the strike area, an effect to secure an adequate strength in the strike area, deformation of the strike area, and an effect to improve a sensing precision.

(8) Bent portions are formed in the periphery of the strike area of the head, wherein the bent portions of the periphery of the head are wound about the periphery of the frame when the frame is attached to the head. It is possible for a worker to reliably attach the frame to the head due to expansion and contraction of the strike area of the head, wherein it is possible to prevent the strike area of the head from becoming separated from the frame during playing of the electronic percussion instrument. This may reduce the number of parts because the present invention does not need additional parts used to mount the head on the frame.

(9) The strike area of the head is made of an elastic material such as rubber, urethane, and silicon, while a flexible material is attached to the surface of the strike area of the head. This improves smoothness on the strike area of the head and a player's sensation to strike the head with a beater. Additionally, it is possible to improve the appearance of the exterior of the head in the electronic percussion instrument.

What is claimed is:

1. An electronic percussion instrument comprising:

a frame;

a head, which is made of an elastic material with a higher flexibility than the frame, wherein the head has a main area including a main strike area, which is disposed in a front side of the frame and which is mainly subjected to a striking operation, and an auxiliary area which includes a fixing part fixed to the frame but does not include the main strike area; and an impact sensor which converts a vibration occurring on the main strike area subjected to a striking operation into an electric signal, wherein at least part of the main area of the head is connected to the auxiliary area via a connecting part which is reduced in thickness in comparison with the auxiliary area.

2. The electronic percussion instrument according to claim 1, wherein the connecting part is horizontally arranged in at least one of an upper portion above the main area or a lower portion below the main area, and wherein the connecting part is linearly elongated across the head.

3. The electronic percussion instrument according to claim 1, wherein the connecting part is made of a groove which is formed in the head.

4. The electronic percussion instrument according to claim 1, wherein the groove is formed in each of the surface and the back of the head.

5. An electronic percussion instrument comprising:

a frame;

a head, which is made of an elastic material with a higher flexibility than the frame, whose backside is divided into a main area and an auxiliary area which are positioned adjacent to each other, wherein the main area includes a main strike area on a surface of the head while the auxiliary area is fixed to the frame, and wherein the main area is reduced in thickness in comparison with the auxiliary area in the head; and an impact sensor which converts a vibration into an electric signal used to generate an electronic musical sound.

6. The electronic percussion instrument according to claim 5, wherein the main area is horizontally elongated in the head.

7. The electronic percussion instrument according to claim 5, further comprising a vibration-damping member which is made of a harder material than the head and which is disposed in at least one of a front side, a rear side, and an inside of the auxiliary area precluding the main strike area in the head.

8. The electronic percussion instrument according to claim 1, wherein the impact sensor is disposed close to the main strike area of the head via a cushion member.

9. The electronic percussion instrument according to claim 5, wherein the impact sensor is disposed close to the main strike area of the head via a cushion member.

10. An electronic percussion instrument comprising:

a frame;

a head, which is made of an elastic material with a higher flexibility than the frame, wherein a main area, including a main strike area which is disposed in a front side of the frame and which is mainly subjected to a striking operation, is connected to an auxiliary area which includes a fixing part fixed to the frame but does not include the main strike area; and an impact sensor which converts a vibration occurring on the main strike area subjected to a striking operation into an electric signal, wherein the main area is horizontally elongated in the head.

11. The electronic percussion instrument according to claim 10, further comprising a vibration-damping member which is made of a harder material than the head and which is disposed in at least one of a front side, a rear side, and an inside of the auxiliary area precluding the main strike area in the head.

12. The electronic percussion instrument according to claim 10, wherein the impact sensor is disposed close to the main strike area of the head via a cushion member.

* * * * *